United States Patent [19]

Yamauchi et al.

[11] Patent Number: 4,459,647

[45] Date of Patent: Jul. 10, 1984

[54] SHADOW-FREE LAMP ASSEMBLY

[75] Inventors: Osamu Yamauchi, Yokohama; Kazuomi Hoashi, Chiba, both of Japan

[73] Assignees: Koito Kogyo Kabushiki Kaisha; Sankin Kogyo Kabushiki Kaisha, both of Japan

[21] Appl. No.: 461,160

[22] Filed: Jan. 26, 1983

[30] Foreign Application Priority Data

Apr. 14, 1982 [JP] Japan ..... 57-53090

[51] Int. Cl.[3] ..... F21V 7/00

[52] U.S. Cl. ..... 362/297; 362/304; 362/346; 362/347; 362/348; 362/349; 362/804

[58] Field of Search ..... 362/346, 348, 804, 297, 362/304, 347, 349

[56] References Cited

U.S. PATENT DOCUMENTS 3,666,939 5/1972 Ota ..... 362/348

4,149,227 4/1979 Dorman ..... 362/348

*Primary Examiner*—Stephen J. Lechert, Jr.

*Attorney, Agent, or Firm*—Diller, Ramik & Wight

[57] ABSTRACT

A shadow-free lamp assembly comprises a plurality of plane mirror segments disposed on a basic paraboloidal reflecting surface, and a linear light source. Each of the plane mirror segments has a length of the short span of the paraboloidal reflecting surface as its long side and is continuously disposed next to each other along the long span of the paraboloidal reflecting surface and the light source is disposed in reflecting direction forward from the focus of the paraboloidal reflecting surface, whereby all mirror segments reflect light from the light source to produce irradiation patterns illuminating the single illumination area. Because of the overlapped illumination by the plurality of the mirror segments, shadow is not produced on the illumination area when reflected light is partially intercepted.

3 Claims, 4 Drawing Figures

SHADOW-FREE LAMP ASSEMBLY

BACKGROUND AND BRIEF SUMMARY OF THE INVENTION

The present invention relates to a shadow-free lamp assembly for use in dental and other purposes wherein shadow produced owing to the presence of a light intercepting body within an illumination area is avoided to a great extent and the beam of the reflected light is diffused uniformly within said illumination area.

In prior art, a so-called shadow-free lamp used as the lighting equipment for dental or other medical treatment comprises a paraboloidal reflector made of heat resisting glass (generally called a cold mirror) and a linear light source such as a linear halogen lamp. Such paraboloidal reflector for the shadow-free lamp should be designed so that the reflector produces a specified irradiation pattern in order to illuminate a particular spot such as an affected part of the patient and that sufficient shadow-free degree and uniformity degree of illumination can be secured even if rays of light are partially intercepted by the entry of some opaque body, such as physician's hand, within this irradiation pattern. However, such prior art shadow-free lamp could not provide sufficient shade-free and uniformity degree of illumination.

Accordingly, an object of the present invention is to provide a shadow-free lamp assembly which can enhance the shadow-free degree and the uniformity degree of illumination which cannot be obtained satisfactorily by conventional shadow-free lamps.

According to this invention, a shadow-free lamp reflector is provided by continuously arranging numbers of plane mirror segments of a rectangular shape along the long span of the paraboloidal reflecting surface. Each of the plane mirror segment is so arranged to reflect the light of a linear light source disposed at a location forward from the paraboloidal reflecting surface so that beams of the reflected light from each mirror segment illuminate a predetermined illumination area.

One preferred embodiment of the invention will now be illustrated by way of example while referring the accompanying drawings.

DETAILED DESCRIPTION OF THE PREFERRED EMBODIMENT

Figure 1:
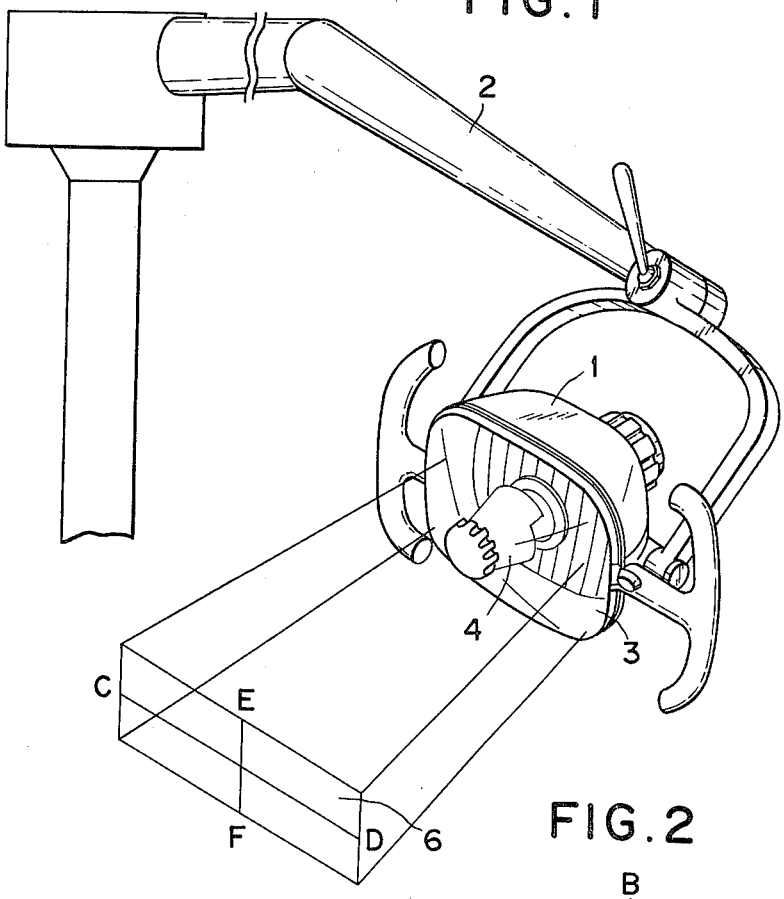
FIG. 1 is an appearance of the lamp assembly of the present invention as it is applied to the dental lighting equipment.
Figure 2:
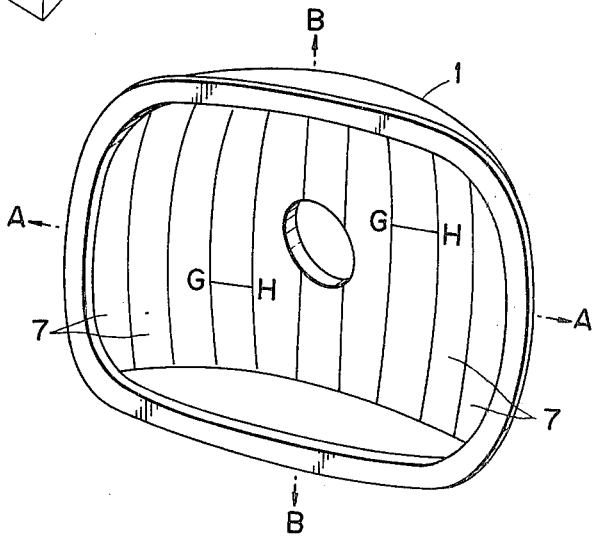
FIG. 2 is a perspective view showing paraboloidal reflecting surface of the lamp assembly.
Figure 3:
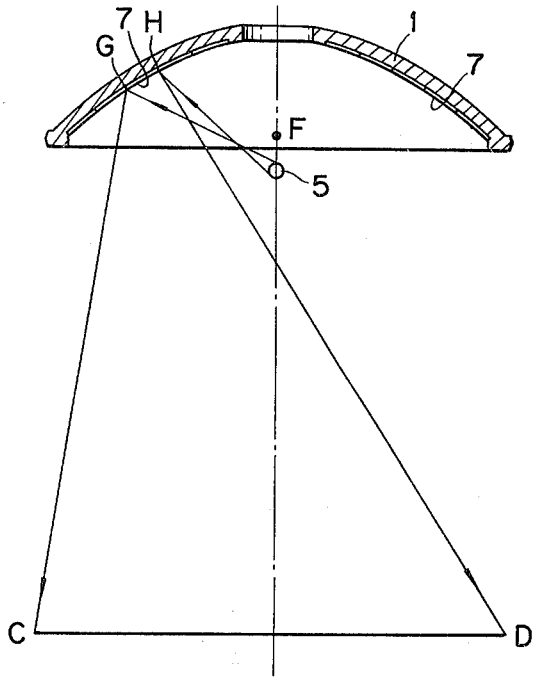
FIG. 3 is a sectional view taken on line A—A of FIG. 2.
Figure 4:
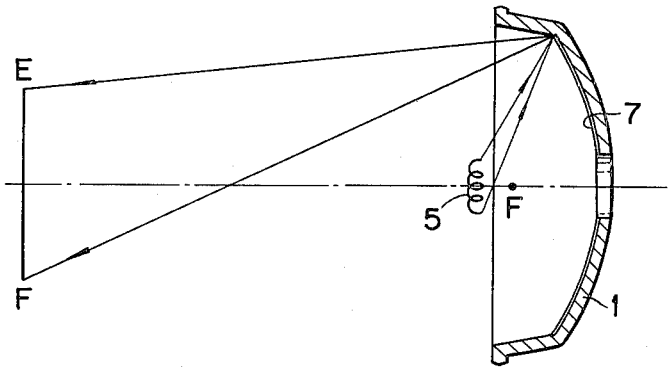
FIG. 4 is a sectional view taken on line B—B of FIG. 2.

Referring to FIG. 1 showing an example of a lamp assembly for the shadow-free illumination applied to the dental lighting equipment, the lamp assembly comprises a paraboloidal reflector 1 typically made of heat resisting glass, an arm 2 supporting the paraboloidal reflector 1, a protective cover 3, and a light source beam intercepting cylinder 4. The paraboloidal reflector 1 has long and short spans, as viewed from the front, and has a basic paraboloidal reflecting surface having a longitudinal length and a transverse width. The paraboloidal reflecting surface is concaved inward, thus being formed as a substantially rectangular concave mirror. A linear light source 5 is disposed along the short span direction of the paraboloidal reflector 1 in front of the basic paraboloidal surface of the paraboloidal reflector 1. By combining the paraboloidal reflector 1 and the linear light source 5, an irradiation pattern 6 is established so as to provide an illumination area having, for example, a long width CD corresponding to the long span of the paraboloidal reflector 1 and a short width EF corresponding to the short span of the paraboloidal reflector 1 at a predetermined distance forward from the paraboloidal reflector. Generally, when the linear light source 5 is disposed at the focus of the paraboloidal reflector 1, the beam of the light reflected by the basic paraboloidal reflecting surface of the paraboloidal reflector 1 becomes the width corresponding to the short span in the short span direction of the paraboloidal reflector 1, or larger than that depending on the size of the light source. For using the reflector as a light equipment for dental treatment or other purposes, it is required that the short width EF of the irradiation pattern 6 is made smaller than the short span of the paraboloidal reflector 1. In order to satisfy this requirement and restrict the beam width of reflected light in the short span direction of the paraboloidal reflector 1 to the short width EF of the illumination area, the linear light source 5 is positioned forward in the reflecting direction from the focus F of the paraboloidal reflector 1. On the other hand, when the linear light source 5 is positioned forward in the reflecting direction from the focus F of the paraboloidal reflector 1, the long width CD of the illumination area cannot be maintained depending on the beam width of the reflected light in the long span direction. On the paraboloidal reflector, numbers of plane mirror segments 7 of a rectangular form with it long side corresponding to the short span of the basic paraboloidal reflecting surface are arranged. Each of these plane mirror segments 7 is formed to a size capable of diffusing the beam of the reflected light over the illumination area located at a predetermined distance forward from the paraboloidal reflector 1, and the mirror segments 7 are disposed continuously in the long span direction of the paraboloidal reflector 1 on the basic paraboloidal reflecting surface. For each plane mirror segment 7 of the length of the side GH is determined so as to be able to irradiate the beam of reflected light corresponding to the long width CD of the illumination area. For the short width EF of the illumination area, the illumination can be assured at all points on the each plane mirror segment 7. Thus, each plane mirror segment 7 is designed so as to be able to form the same irradiation pattern against the illumination area. Because of the overlapped irradiation on the same illumination area by the beam reflected from plural mirror segments 7, even if a light intercepting body enters the irradiation pattern, rays of light area intercepted only partially, the irradiation pattern in overall illumination area remains undisturbed, and the image of the light intercepting body becomes hard to appear.

The size of the illumination area, i.e., the dimensions of the long width CD and the short width EF of the illumination area can be changed according to the purpose of using the shadow-free lamp reflector according to this invention. Moreover, the directions of long and short spans of the paraboloidal mirror 1, i.e., which one is to be put in the vertical or horizontal direction, can be chosen arbitrarily.

We claim:

1. A shadow free lamp assembly comprising a light source disposed forward in the reflecting direction from the focus of a basic paraboloidal reflecting surface, said paraboloidal reflecting surface having a longitudinal length and a transverse width, a plurality of mirror segments each having a longitudinal length and a transverse width, said plurality of mirror segments being disposed continuously in lengthwise side-by-side relationship to each other along the longitudinal length of said basic paraboloidal reflecting surface, each of said mirror segments having a straight transverse section and a parabolic longitudinal section, the longitudinal length of each mirror segment being generally equal to the transverse width of said basic paraboloidal reflecting surface, and said mirror segments being arranged such that light reflected from each of said mirror segments overlappingly irradiates the same illuminated area.

2. A shadow free lamp assembly as defined in claim 1 wherein the transverse width of said mirror segments are determined so that reflecting light from said mirror segments overlappingly irradiate the same illumination area.

3. A shadow free lamp assembly as defined in claim 1 or claim 2 wherein said light source is a linear light source.

* * * * *